US006250634B1

(12) United States Patent
Strain et al.

(10) Patent No.: US 6,250,634 B1
(45) Date of Patent: Jun. 26, 2001

(54) BOUNCE BACK SPORTS APPARATUS

(76) Inventors: Joseph W. Strain, 2914 Bee Tree La.; Joseph W. Milligan, 2932 Spring Water Dr., both of St. Louis, MO (US) 63129

( * ) Notice: Subject to any disclaimer, the term of this patent is extended or adjusted under 35 U.S.C. 154(b) by 0 days.

(21) Appl. No.: 09/310,304

(22) Filed: May 12, 1999

Related U.S. Application Data

(63) Continuation of application No. 08/717,244, filed on Sep. 20, 1996, now Pat. No. 5,934,679.

(51) Int. Cl.[7] ..... A63B 69/00

(52) U.S. Cl. ..... 273/395; 473/435; 473/454; 473/471; 273/127 C

(58) Field of Search ..... 473/435, 528, 473/FOR 212, 400, 471, 434, 454; 273/395, 396, 127 C

(56) References Cited

U.S. PATENT DOCUMENTS

| | | | |
|---|---|---|---|
| 1,612,920 | 1/1927 | Hillstrom | 473/435 |
| 2,482,234 | 9/1949 | Barker | 273/395 |
| 2,988,362 | 6/1961 | Brewer | 273/177 |
| 2,992,002 | 7/1961 | Bingham, Jr. | 273/95 |
| 3,195,898 | 7/1965 | Respini | 273/181 |
| 3,706,451 | 12/1972 | Dixon | 273/26 A |
| 3,840,228 | 10/1974 | Greaney | 273/1 B |
| 3,856,298 | 12/1974 | Frantti | 273/1 B |
| 3,944,223 | 3/1976 | Bromwell | 273/1 B |
| 4,083,561 | 4/1978 | Daffer, Jr. | 273/103 |
| 4,239,235 | 12/1980 | Torres | 273/395 |
| 4,264,070 | 4/1981 | Torres | 273/29 A |
| 4,844,478 | 7/1989 | Kessler | 273/411 |
| 5,246,229 | 9/1993 | Carey | 273/127 C |
| 5,294,115 | 3/1994 | Phillips et al. | 273/67 R |
| 5,356,135 | 10/1994 | Montgomery | 273/57.2 |
| 5,362,045 | 11/1994 | Hammett et al. | 273/57.2 |
| 5,509,650 | 4/1996 | MacDonald | 273/26 R |

FOREIGN PATENT DOCUMENTS

| | | | |
|---|---|---|---|
| 2341666 | 2/1975 | (DE) | 273/FOR 212 |
| 82661 | 6/1962 | (FR) | 273/395 |

OTHER PUBLICATIONS

McMaster–Carr Catalog, "Foam Rolls & Strips," pp. 2448–2460, (pre 1995).

Firestone, "RubberGard EPDM Roofing Membrane," product brochure, 2 pages (May, 1995).

UniRubber, Inc., "General Product List," product brochure, 6 pages (date unknown, but believed to be pre 1995).

*Primary Examiner*—Mark S. Graham
(74) *Attorney, Agent, or Firm*—Senniger, Powers, Leavitt & Roedel

(57) ABSTRACT

A sports apparatus for bouncing back a sports object after the sports object strikes the sports apparatus is also disclosed. The sports apparatus includes a frame defining an opening therethrough and an elastomeric sheet stretched about the frame and covering the opening. The elastomeric sheet is perforated with a plurality of perforations through the sheet and is secured to the frame. The elastomeric sheet flexes upon being struck by the sports object and bounces the sports object back from the sports apparatus. A method of building a sports apparatus for bouncing back a sports object and a hand-held sports racket for striking a sports object are also disclosed. Other embodiments and features of the invention are also disclosed.

20 Claims, 6 Drawing Sheets

BOUNCE BACK SPORTS APPARATUS

REFERENCE TO RELATED APPLICATIONS

This application is a continuation of U.S. application Ser. No. 08/717,244 filed on Sep. 20, 1996, now U.S. Pat. No. 5,934,679.

BACKGROUND OF THE INVENTION

Conventional bounce back nets and targets for use in sports have been constructed of nylon or fibre nets suspended within a frame by springs or other elastic members. A disadvantage of such nets is that they are relatively expensive and require unnecessary labor to manufacture. An example of such a net is shown in U.S. Pat. No. 3,706,451.

A low profile rebounding apparatus for use in hockey is also known in the art. This apparatus uses an elastic band stretched in a triangular shape around three vertical supporting members with a rather elaborate tensioning mechanism. Such apparatus is unusable for anything other than low passes during hockey practice. An example is shown in U.S. Pat. No. 5,326,045.

SUMMARY OF THE INVENTION

Among the objects of the present invention are to provide improved sports bounce back apparatus which are lightweight and inexpensive to manufacture yet are durable and resistant to the weather; to provide improved sports bounce back apparatus made from a single sheet of perforated elastomeric material; to provide improved sports bounce back apparatus which absorbs the shock of being struck by a sports object at higher speeds and which tends to more consistently return the sports object along a more defined path; to provide improved sports bounce back apparatus which do not require separate springs or pulleys; to provide improved sports bounce back apparatus which are easily adjusted in the field; and to provide improved sports bounce back apparatus which are easy to manufacture and maintain.

Generally, one form of the invention is a bounce back hockey net for use with a hockey puck. The hockey net includes a three dimensional frame defining a target area and an elastomeric sheet secured to the frame. The elastomeric sheet is perforated with a plurality of perforations positioned over at least 50% of the surface area of the sheet. The elastomeric sheet flexes upon being struck by the hockey puck and bounces the hockey puck back from the hockey net.

Another form of the invention is a sports apparatus for bouncing back a sports object after the sports object strikes the sports apparatus. The sports apparatus includes a frame defining an opening therethrough and an elastomeric sheet stretched about the frame and covering the opening. The elastomeric sheet is perforated with a plurality of perforations through the sheet. The elastomeric sheet is secured to the frame. The sheet flexes upon being struck by the sports object and bounces the sports object back from the sports apparatus.

Still another form of the invention is a hand-held sports racket for striking a sports object. The hand-held sports racket includes a frame defining an opening therethrough and an elastomeric sheet stretched about the frame and covering the opening. The elastomeric sheet is perforated with a plurality of perforations through the sheet. The sheet is secured to the frame.

Yet another form of the invention is a method of building a sports apparatus for bouncing back a sports object after the sports object strikes the sports apparatus. The method includes the steps of determining a size and a weight of the sports object and selecting a perforated elastomeric sheet of material as a function of the size and weight of the sports object. The method further includes the steps of selecting a frame defining an opening therethrough and stretching the perforated elastomeric sheet of material about the frame to cover the opening. The method also includes the step of securing the perforated elastomeric sheet of material to the frame.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
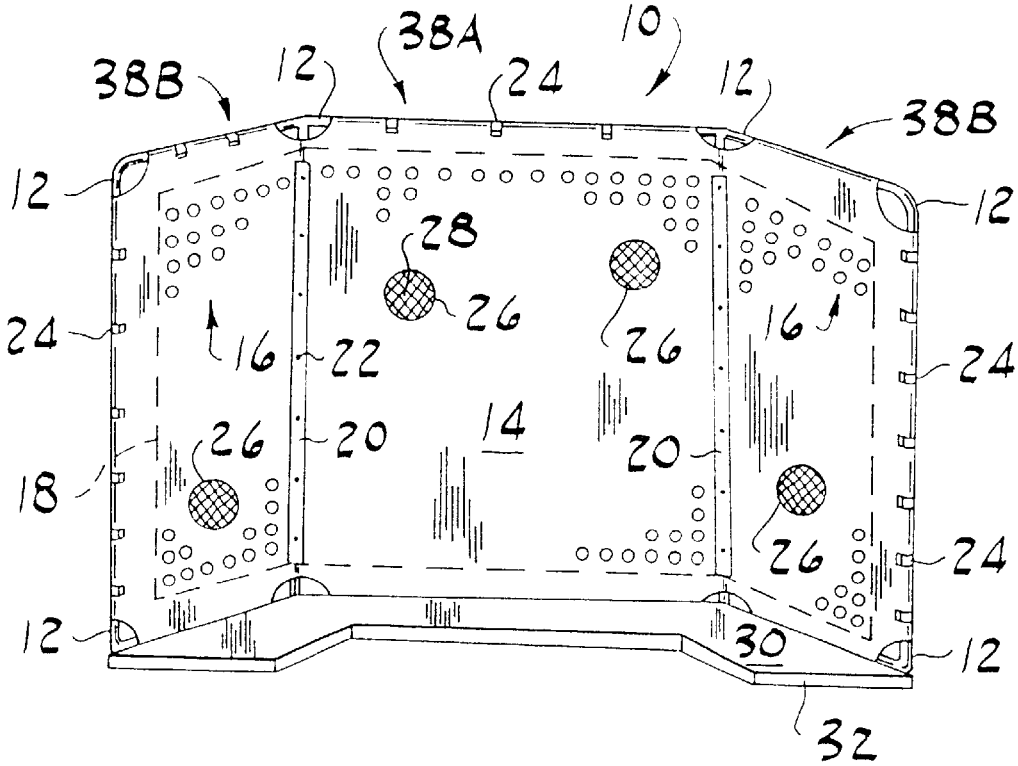
FIGS. 1, 1A and 2 show a hockey net of the present invention.

FIG. 1 shows a hockey net 10 of the present invention. Hockey net 10 is supported by a frame 12 made of plastic pipes, such as PVC pipes, which are preferably glued together. Metal pipes and the like may also be used. The outer limits of frame 12 define an opening therethrough. An elastomeric sheet 14 is stretched about frame 12 to cover the opening. Sheet 14 includes a plurality of perforations 16 positioned within a dashed line 18. Although only a few perforations 16 are shown in FIG. 1, it is understood that perforations 16 would be found all across sheet 14 within dashed line 18. For use in a hockey net, perforations 16 preferably define a repeated pattern and have a circular shape with a diameter of about ⅜ of an inch centered ⅝ of an inch apart. Other shapes, sizes and separation distances may also be used within the scope of the invention. A pair of plastic or metal strips 20 hold sheet 14 back against the vertical uprights of frame 12, thus keeping the rebounding area relatively flat and sheet 14 taut. Suitable fasteners 22 pass through strips 20 and sheet 14 and into frame 12 to trap sheet 14 in position against frame 12.

A plurality of plastic clips 24 fasten sheet 14 to frame 12 along the outer periphery of frame 12. Clips 24 may be short C-shaped sections of unused PVC pipe which have had a portion sliced out. Clips 24 thus wrap around frame 12 and fasten sheet 14 in position via friction. Clips 24 may be manually rotated overtime to maintain the tension across sheet 14. If it is desired to fix the position of clips 24 more securely, a longitudinal slot may be cut in the clips through which a screw passes for more secure attachment to frame 12. In use, the slot allows the clip to be rotated to increase the tension across sheet 14 and then the screw is tightened to fix the position of the clip on frame 12. As another alternative, sheet 14 may be securely attached to a rotatable member comprising frame 12. The rotatable member is then rotated until the desired amount of tension is applied across sheet 14. The rotatable member is then held in position with, for example, an internal ratchet mechanism (not shown) as commonly understood by those skilled in the art. As yet another alternative, the sheet 14 could be glued to frame 12 or molded in one piece with frame 12. Those skilled in the art will recognize many other suitable means for securing sheet 14 to frame 12, in addition to those listed above.

It is seen then that dashed line 18 demarcates a border in sheet 14 of unperforated material adjacent frame 12. This border is engaged in part by clips 24 for securing elastomeric sheet 14 to frame 12. This border also bounds an inner area on sheet 14 which inner area contains the perforations 16. This inner area is preferably at least as big as 50% of the size of the opening defined by the outer periphery of frame 12. Large holes 26 may be cut in sheet 14 to provide targets. A mesh bag 28 is molded into or attached to the backside of sheet 14 to form a pocket for retaining any pucks shot on target.

Hockey net 10 also includes a base 30 having a beveled edge 32. Edge 32 allows a hockey puck traveling along the ground to slide over base 30 and into net 10. Edge 32 thus redirects a puck sliding along the ground up into net 10 so that it can be bounced out instead of simply hitting the frame as with a conventional hockey net. Frame 12 is preferably a tubular frame (as shown) secured to base 30. Frame 12 defines a back wall 38A and a pair of side walls 38B which project at an angle from either side of back wall 38A.

Figure 1A:
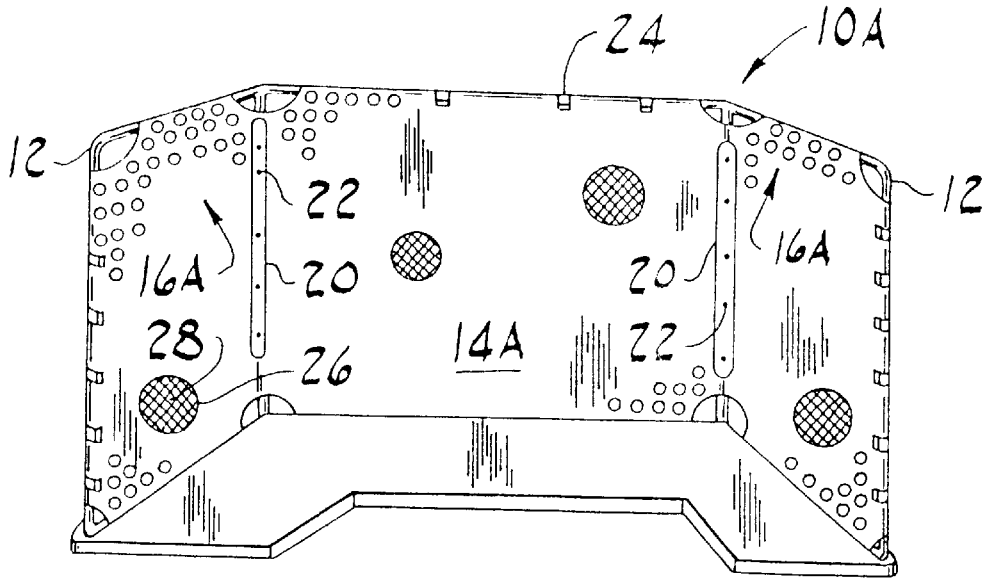

FIG. 1A shows a hockey net 10A which is similar to net 10 in FIG. 1 except that the perforations 16A in sheet 14A are found over the entire surface of sheet 14A up to frame 12. There is no unperforated border near frame 12 as otherwise demarcated by dashed line 18 in FIG. 1. This use of a more completely perforated sheet 14A (without any unperforated border) as shown in FIG. 1A allows for even greater bounce back of the hockey puckey in many situations.

Figure 2:
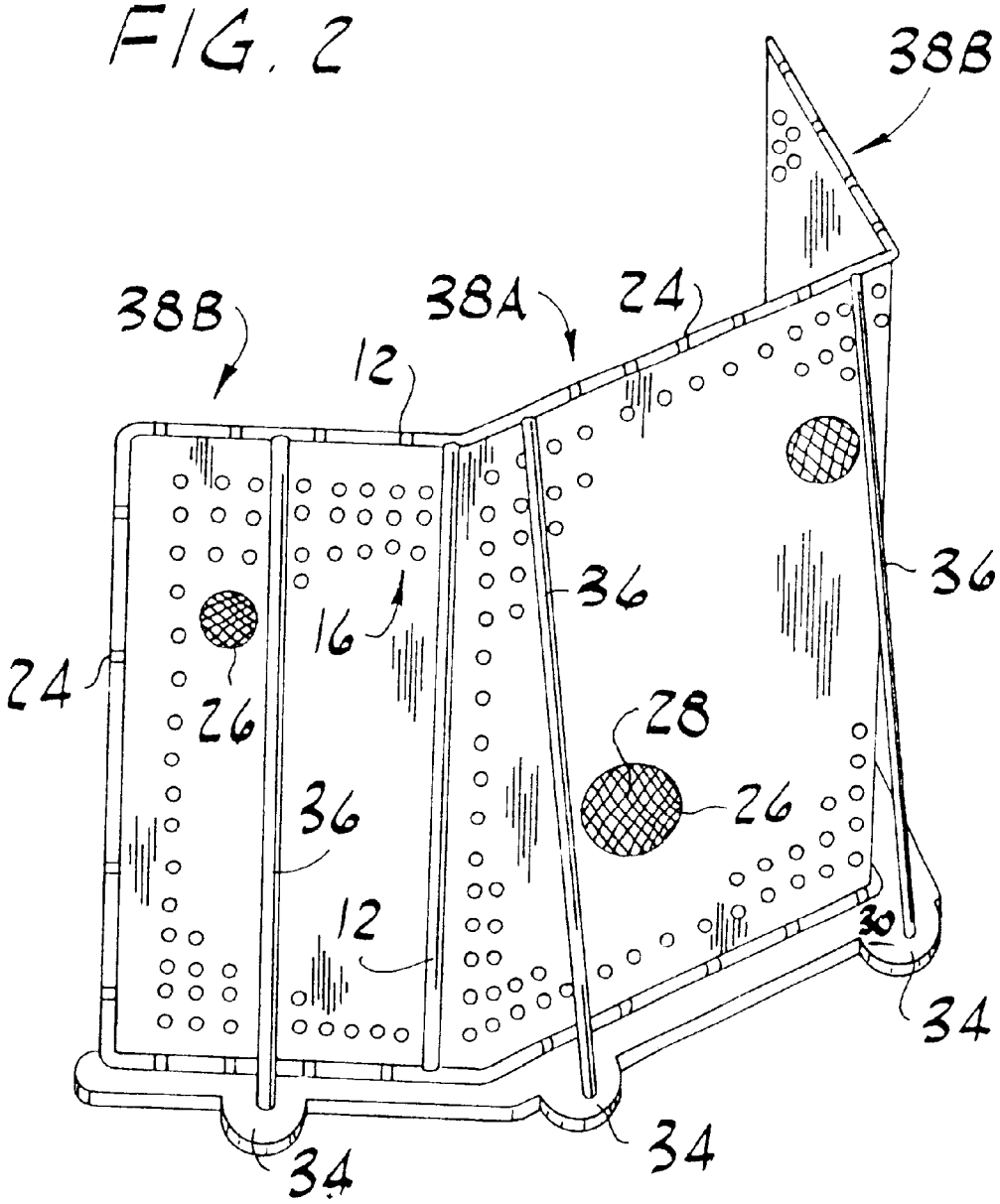

FIG. 2 shows a perspective view of hockey net 10 from the reverse side. It is there seen that base 30 includes extensions 34 which support frame outriggers 36 which project downwardly at an angle from the top of frame 12 to extensions 34. When a shot on goal is taken, elastomeric sheet 14 flexes upon being struck by the hockey puck and bounces the puck back away from the net. Extensions 34 and outriggers 36 help absorb the shock from the puck and hold hockey net 10 in position. Hockey net 10 thus constitutes a sports apparatus for bouncing back a sports object such as a hockey puck after the sports object strikes the sports apparatus.

Figure 3:
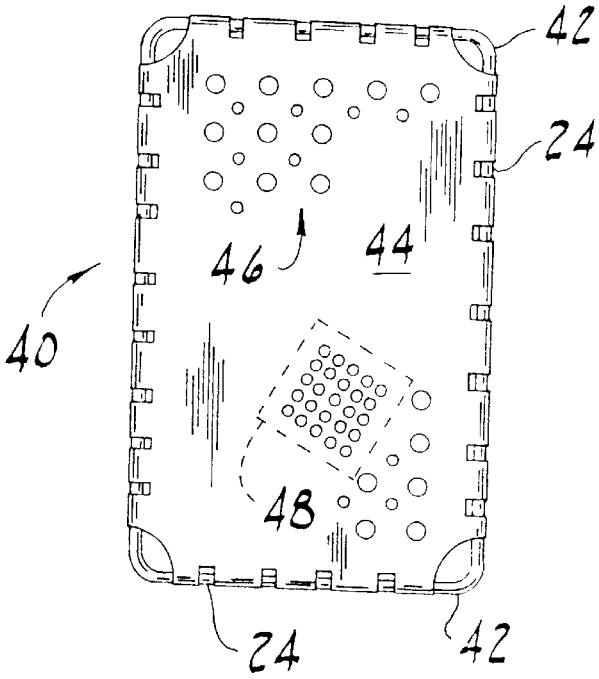
FIGS. 3 and 4 show an adjustable bounce back net of the present invention for baseballs, basketballs, footballs, tennis balls and other sports objects.
Figure 4:
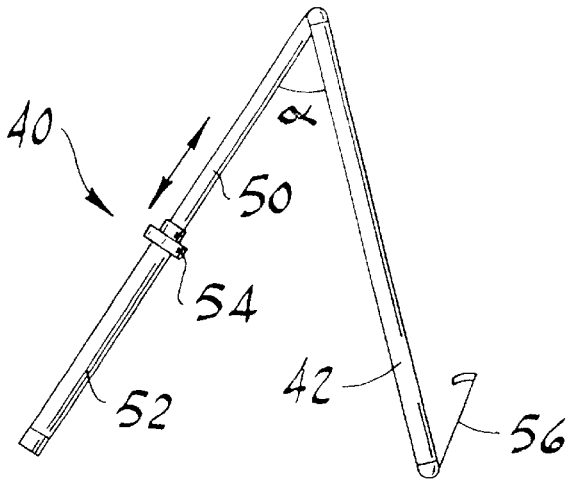

FIGS. 3 and 4 show an adjustable bounce back net 40 of the present invention for baseballs, basketballs, footballs, tennis balls and other sports objects. Net 40 includes a frame 42 defining an opening therethrough. An elastomeric sheet of material 44 is stretched about frame 42 to cover the opening. Elastomeric sheet 44 is perforated with a plurality of perforations 46 through the sheet. It will be noted that perforations 46 can be made in a variety of sizes, shapes and configurations. The perforations shown by example in FIGS. 3 and 4 are of two sizes, large and small. Clips 24 fasten and secure sheet 44 to frame 42 along an unperforated border area as with sheet 14 in FIG. 1. A plurality of smaller, more closely spaced perforations are shown within a dashed line 48 to provide a visible target. Similarly, sheet 44 may include an unperforated area to define a target. Elastomeric sheet 44 flexes upon being struck by a sports object and bounces the sports object back from net 40.

FIG. 4 shows a side view of net 40. The back leg of net 40 includes a first frame member 50 which telescopes in and out of a second frame member 52 to adjust the angle of net 40. A hand-tightened locking mechanism 54 is used to fix the position of member 50 with respect to member 52. A stake 56 may be used to hold the front edge of net 40 against the ground.

Figure 5:
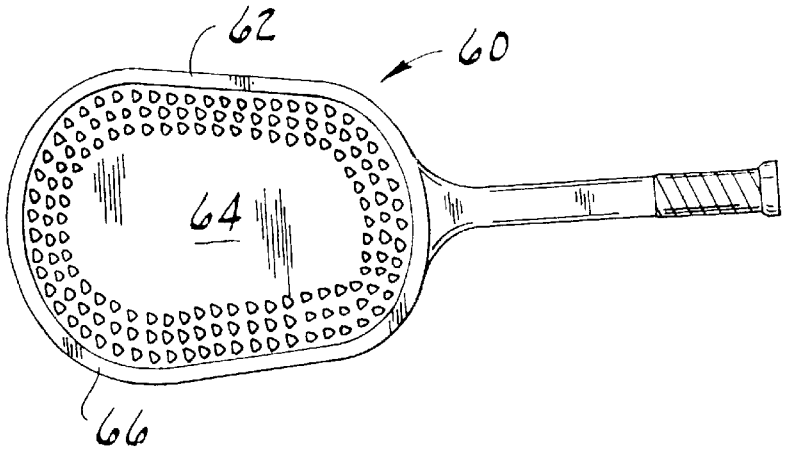
FIG. 5 shows a hand-held racket of the present invention.

FIG. 5 shows a hand-held sports racket 60 for striking a sports object. Racket 60 includes a frame 62 defining an opening therethrough. An elastomeric sheet 64 is stretched about frame 62 and covers the opening. Elastomeric sheet 64 is perforated with a plurality of perforations through the sheet. Fasteners 66 secure sheet 64 to frame 62. Alternatively, elastomeric sheet 64 may comprise roofing rubber, neoprene, nitrile, EPDM, hypalon, SBR, urethane, latex, silicone and/or viton®.

Figure 6:
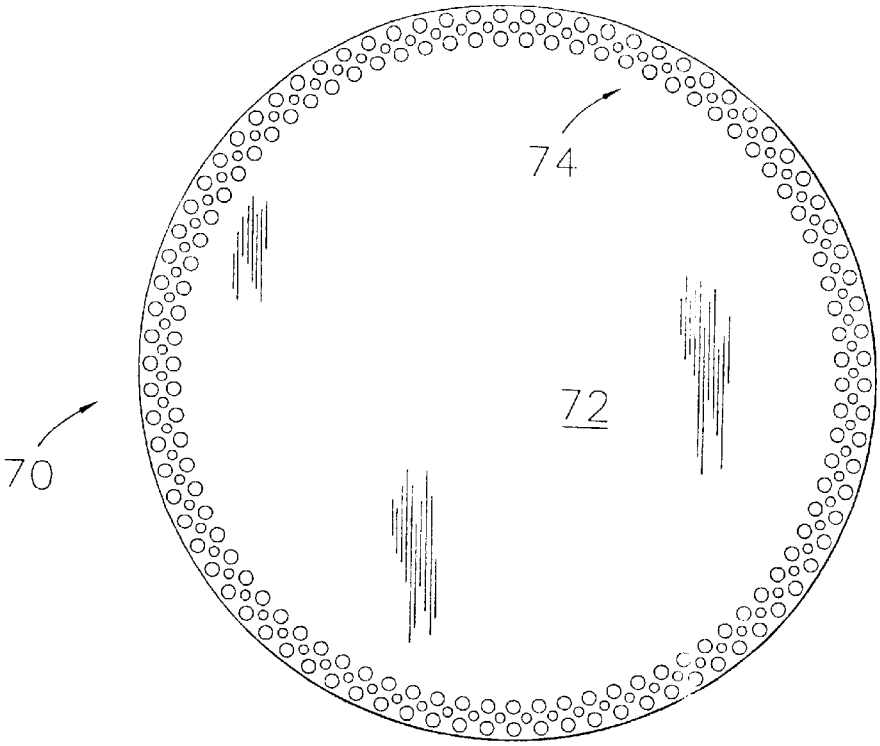
FIG. 6 shows a trampoline of the present invention.

FIG. 6 shows a trampoline 70 of the present invention. Trampoline 70 includes an elastomeric sheet 72 stretched over a conventional trampoline frame. A plurality of perforations 74 take the place of conventional trampoline springs.

Figure 7:
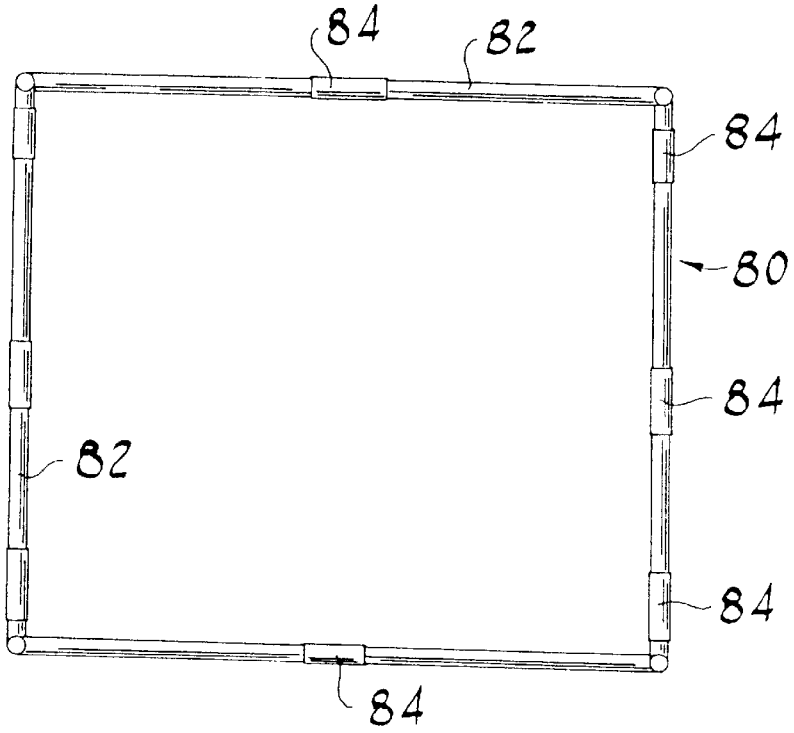
FIGS. 7 and 8 show an adjustable frame for use with the present invention.
Figure 8:
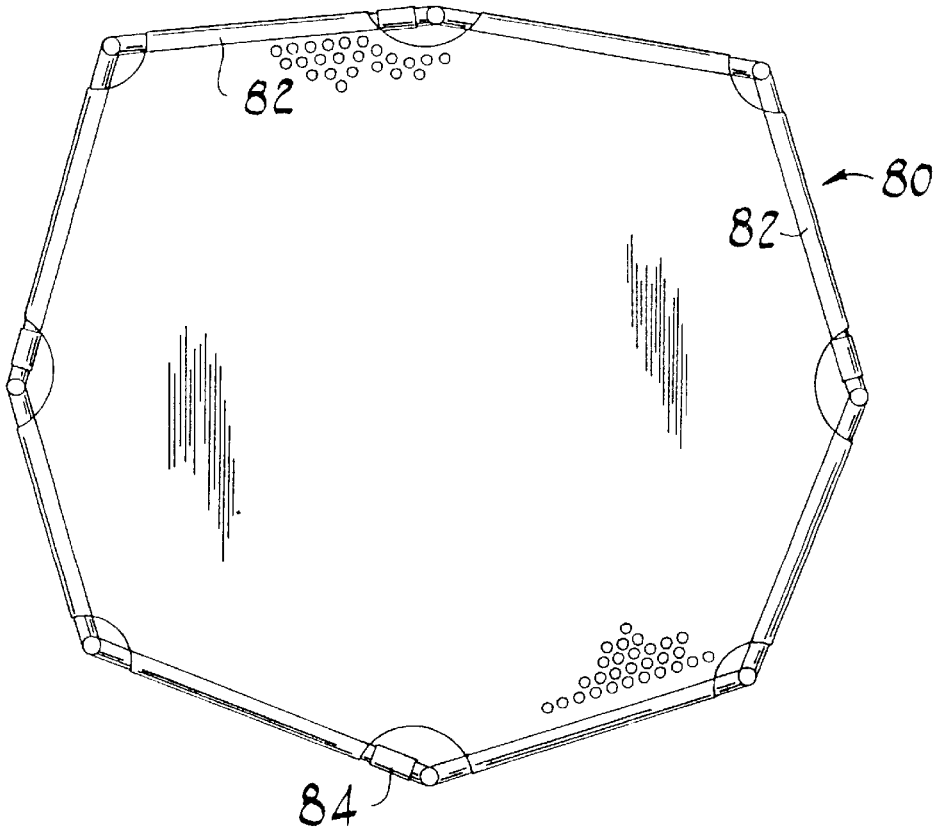

FIGS. 7 and 8 show an adjustable frame 80 for use with the present invention. This frame illustrates an embodiment of the invention that can be used to attach a two-dimensional panel of material stretched over a frame to an already existing hockey goal or other structure. Frame 80 includes a plurality of frame sections 82 which may be locked end on end with each other via locking collars 84. When locking collar 84 is slipped over adjacent ends of adjacent frame sections 82, the sections are held in place. When locking collar 84 is slipped back onto a single section 82, then the adjacent section is free to move.

In practice, each of the perforations shown in the elastomeric sheets of FIGS. 1 through 6 defines a separate area. A summation of each of the areas of each of the perforations in any one of these Figures sums to a perforated area sum. The perforated area sum is preferably in the range of about 10% to 75% of the area defined by the opening formed by the outer peripheries of each of the respective frames shown in these Figures. Alternatively, the perforated area sum may be in the range of about 20% to 55% of said openings formed by said outer peripheries.

In further practice, the perforated elastomeric sheets of material shown in FIGS. 1 through 6 can be made from a continuous sheet of EPDM rubber. EPDM rubber is manufactured by several companies in the United States and abroad, such as the Firestone company, and is commonly used in the commercial roofing and automotive industries because of its versatility and durability. In roofing applications, EPDM is commonly warranted for 20 years which shows that this material is highly resistant to the weather and should hold up well in the outdoor environment in which sports apparatus of the present invention is commonly used. EPDM rubber is superior to the netting commonly found in the prior art because, unlike the prior art netting, EPDM rubber is unlikely to become entangled with objects such as hockey sticks, skates or other equipment during play or storage. This reduces the chance of injury to the player or damage to the material. Other types of elastomeric sheets may also be used within the scope of the invention. Such other types include, but are not limited to, neoprene, nitrile, EPDM, hypalon, SBR, urethane, latex, silicone and/or viton®.

The elastomeric sheet may be perforated in accordance with the present invention by machine stamping, cutting, injection molding, weaving or otherwise. The perforations in the sheet can be made larger, smaller, differently shaped and/or differently spaced to achieve a desired rebound, deflection or blocking system in all sports without the use of springs, pulleys, flexing frames or any of the other currently used prior art designs.

The best results for rebound and deflective purposes have been achieved by keeping the spacing between the perforations to a minimum. This allows the material to stretch farther and with less effort. The size, shape and configuration of the perforations are determined as a function of the size, shape and weight of the sports object being propelled against the perforated sheet. The area between the perforations and the ideal thickness of the perforated sheet is also determined as a function of the size, shape and weight of the sports object.

As a general rule, thicker elastomeric sheets of material will require larger perforations more closely spaced together than thinner sheets. Likewise, lighterweight sports objects will require thinner sheets of material and/or larger perforations and/or more closely spaced perforations. Sports frames which define a larger area require thinner sheets of material and/or larger perforations and/or more closely spaced perforations. In the apparatus shown in FIGS. 1 through 8 as described above, the respective elastomeric sheets may have a thickness in the range of about 20 mil to about 100 mil., although a range of about 40 mil to about 65 mil is acceptable for most applications. It is noted that some trampoline applications may required elastomeric sheets which are substantially thicker than these ranges would otherwise indicate.

As an experiment, the inventors constructed a rigid rectangular frame 42 inches by 32 inches and stretched various elastomeric sheets of EPDM over the frame. After supporting the frame at the corners, a regulation basketball and a regulation softball were separately dropped onto the center of the stretched sheets from 8 feet, 8 inches (at the top of the ball prior to dropping). The average height of the rebounding ball was then measured at the center of the ball.

Figure 9:
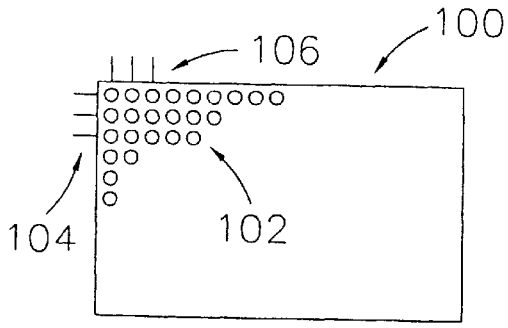
FIGS. 9, 10 and 11 show elastomeric sheets attached to frames wherein the sheets include perforation patterns used in conducting testing on the present invention.

In FIG. 9, frame 100 shows a 60 mil sheet of EPDM containing perforations 102. The diameter of perforations 102 was 7/16 of an inch. The center lines of perforations 102 are shown by lines 104 and 106. For this experiment, lines 104 and 106 were evenly spaced at ¾ inch intervals. Upon being dropped from 8 feet, 8 inches as above, the softball rebounded to an average height of 29 inches and the basketball rebounded to an average height of 51 inches.

Figure 10:
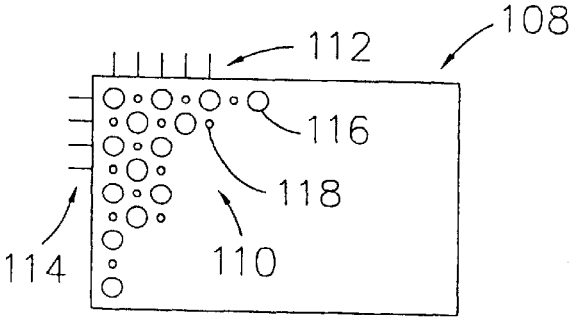

In FIG. 10, frame 108 shows a 45 mil sheet of EPDM containing perforations 110. The diameter of perforations 110 was alternately 7/16 and ¾ of an inch. The center lines of perforations 110 are shown by lines 112 and 114. For this experiment, lines 112 and 114 were evenly spaced at 1 inch intervals. Upon being dropped from 8 feet, 8 inches as above, the softball rebounded to an average height of 44 inches and the basketball rebounded to an average height of 55 inches.

Figure 11:
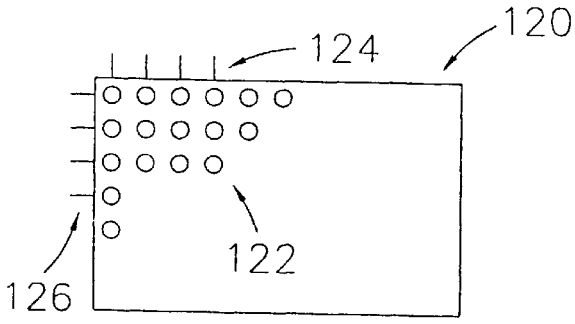

In FIG. 11, frame 120 shows a 60 mil sheet of EPDM containing perforations 122. The diameter of perforations 122 was 1 7/16 inches. The center lines of perforations 122 are shown by lines 124 and 126. For this experiment, lines 124 and 126 were evenly spaced at 2 inch intervals. Upon being dropped from 8 feet, 8 inches as above, the softball rebounded to an average height of 32 inches and the basketball rebounded to an average height of 52 inches.

As another experiment, the 32 by 42 inch frame was covered with a solid sheet of 60 mil EPDM material. Upon being dropped from 8 feet, 8 inches as above, the softball rebounded to an average height of 6 inches and the basketball rebounded to an average height of 30 inches.

In practice, it has been found that rows of ⅜ inch diameter holes with centers spaced ⅝ of an inch apart (in both directions—up/down and side to side) in 45 mil thick EPDM rubber is the best combination for a hockey net.

It is thus seen that the present invention teaches a method of building a sports apparatus for bouncing back a sports object after the sports object strikes the sports apparatus. The method includes the steps of determining a size and a weight of the sports object; selecting a perforated elastomeric sheet of material as a function of the size and weight of the sports object; selecting a frame defining an opening therethrough; stretching the perforated elastomeric sheet of material about the frame to cover the opening; and fastening the perforated elastomeric sheet of material to the frame. It is noted that the step of selecting a perforated elastomeric sheet of material may include the steps of selecting an unperforated elastomeric sheet of material as a function of the size and weight of the sports object and perforating said unperforated sheet with perforations having an area and a spacing determined as a function of the size and weight of the sports object.

Figure 12:
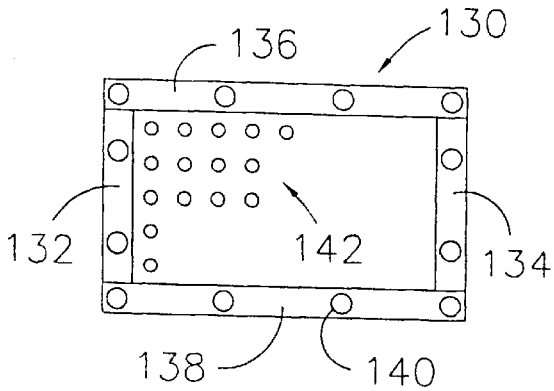
FIG. 12 shows an all purpose net.

FIG. 12 shows an all purpose net 130. Net 130 is made from an elastomeric sheet (such as 60 mil EPDM) as above wherein the side margins 132 and 134 have been folded over to increase the strength of the sides of net 130. The top and bottom margins 136 and 138 have also been folded over to increase their strength as well. A plurality of grommets 140 are positioned in side margins 132 through 138 for use in fastening net 130 with ropes, hooks, fasteners and the like. Net 130 includes a plurality of perforations 142 which allows net 130 to be more easily stretched when a load is put on net 130. The size of net 130 may be varied according to the application for which it is to be used. Net 130 may be used, for example, as a cargo net, truck bed cover, safety net, debris net, boat cover, hammock, safety fence, child safety fence, general purpose replacement net or fish net. Likewise, when stretched over a suitable frame, net 130 may be used for lawn furniture.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A stationary sports target adapted for use in bouncing back a sports object after the sports object strikes the sports target, the stationary sports target being further adapted for use on a sports playing field, the stationary sports target comprising:

a stationary frame defining a fixed target area;

an elastomeric sheet stretched about and secured to the stationary frame; and an anchor for securing the stationary frame relative to the sports playing field;

wherein the elastomeric sheet is perforated with a plurality of perforations through the sheet;

wherein the perforations define an opening which is smaller than an external dimension of the sports object; and wherein a thickness of the elastomeric sheet and the plurality of perforations correspond to a weight of the sports object so that the perforated elastomeric sheet flexes upon being struck by the sports object and bounces the sports object back from the stationary sports target.

2. The stationary sports target of claim 1 wherein the plurality of perforations are positioned over at least 50% of a surface area of the sheet, said perforations causing an elasticity which promotes bounce back of the sports object upon the sports object striking the elastomeric sheet.

3. The stationary sports target of claim 2 wherein the elastomeric sheet has a thickness in the range of about 40 mil to about 65 mil.

4. The stationary sports target of claim 1 wherein the plurality of perforations have a circular shape with a diameter of about ⅜ of an inch centered about ⅝ of an inch apart, said perforations causing an elasticity which promotes bounce back of the sports object upon the sports object striking the elastomeric sheet.

5. The stationary sports target of claim 1 wherein the elastomeric sheet comprises:

a border of unperforated material adjacent the stationary frame, the border being engaged in part by a fastener for securing the elastomeric sheet to the stationary frame; and an inner area bounded by the border, the inner area containing the perforations.

6. The stationary sports target of claim 1 wherein the elastomeric sheet comprises a first area adjacent the stationary frame and a second area inside the stationary frame; wherein the first area has no perforations; wherein the second area is perforated; and wherein the second area is at least as big as 50% of the size of the fixed target area.

7. The stationary sports target of claim 1 wherein the elastomeric sheet comprises roofing rubber.

8. The stationary sports target of claim 1 wherein the elastomeric sheet comprises roofing rubber, neoprene, nitrile, EPDM, hypalon, SBR, urethane, latex, silicone and/or viton®.

9. The stationary sports target of claim 1 wherein the plurality of perforations define a repeated pattern in the elastomeric sheet.

10. The stationary sports target of claim 1 wherein the elastomeric sheet further comprises an unperforated area defining a target on the elastomeric sheet.

11. The stationary sports target of claim 1 wherein each of the perforations define an area; wherein a summation of the areas of each of the perforations sums to a perforated area sum; and wherein the perforated area sum is in the range of about 10% to 75% of the fixed target area.

12. The stationary sports target of claim 1 wherein the perforated area sum is in the range of about 20% to 55% of the fixed target area.

13. The stationary sports target of claim 12 wherein the elastomeric sheet comprises roofing rubber.

14. The stationary sports target of claim 13 wherein the plurality of perforations have a circular shape with a diameter of about ⅜ of an inch centered about ⅝ of an inch apart, said perforations causing an elasticity which promotes bounce back of the sports object upon the sports object striking the elastomeric sheet.

15. The stationary sports target of claim 1 wherein the elastomeric sheet has a thickness in the range of about 20 mil to about 100 mil.

16. The stationary sports target of claim 1 wherein the elastomeric sheet has a thickness in the range of about 40 mil to about 65 mil.

17. A method of building a stationary sports apparatus for bouncing back a sports object after the sports object strikes the stationary sports apparatus, the stationary sports apparatus for use on a sports playing field, the method comprising the steps of:

determining a size and a weight of the sports object;

selecting a perforated elastomeric sheet of material as a function of the size and weight of the sports object;

selecting a stationary frame defining a fixed target area therethrough;

stretching the perforated elastomeric sheet of material about the stationary frame to cover the fixed target area;

securing the perforated elastomeric sheet of material to the stationary frame; and providing an anchor for securing the stationary frame relative to the sports playing field.

18. The method of claim 17 wherein the step of selecting a perforated elastomeric sheet of material comprises the steps of:

selecting an unperforated elastomeric sheet of material as a function of the size and weight of the sports object; and perforating said unperforated sheet with perforations having an area and a spacing determined as a function of the size and weight of the sports object.

19. The method of claim 17 wherein the step of selecting a perforated elastomeric sheet of material comprises the step of selecting said sheet from a group of materials comprising: roofing rubber, neoprene, nitrile, EPDM, hypalon, SBR, urethane, latex, silicone and viton®.

20. A sports kit comprising:

a sports object;

a stationary frame defining a fixed target area;

an elastomeric sheet stretched about and secured to the stationary frame; and an anchor for securing the stationary frame;

wherein the elastomeric sheet is perforated with a plurality of perforations through the sheet;

wherein the perforations define an opening which is smaller than an external dimension of the sports object; and wherein a thickness of the elastomeric sheet and the plurality of perforations correspond to a weight of the sports object so that the perforated elastomeric sheet flexes upon being struck by the sports object and bounces the sports object back from the stationary sports target.

* * * * *